United States Patent [19]

Ohashi et al.

[11] 4,331,196

[45] May 25, 1982

[54] PROCESS FOR PRODUCING NON-DIRECTIONAL ELECTRICAL STEEL SHEETS FREE FROM RIDGING

[75] Inventors: Tetsuro Ohashi; Masafumi Okamoto; Hiromu Fujii, all of Himeji, Japan

[73] Assignee: Nippon Steel Corporation, Tokyo, Japan

[21] Appl. No.: 819,277

[22] Filed: Jul. 27, 1977

[30] Foreign Application Priority Data

Jul. 27, 1976 [JP] Japan ..... 51/89346

[51] Int. Cl.[3] ..... B22D 27/02

[52] U.S. Cl. ..... 164/468; 164/476

[58] Field of Search ..... 164/48, 49, 146, 147, 164/250

[56] References Cited

U.S. PATENT DOCUMENTS

| | | | |
|---|---|---|---|
| 2,084,336 | 6/1937 | Goss | 148/111 |
| 2,867,557 | 1/1959 | Crede et al. | 148/111 |
| 2,963,758 | 12/1960 | Pestel et al. | 164/49 |
| 3,952,791 | 4/1976 | Ito et al. | 164/82 X |

*Primary Examiner*—R. L. Spruill

*Assistant Examiner*—K. Y. Lin

*Attorney, Agent, or Firm*—Wenderoth, Lind & Ponack

[57] ABSTRACT

Improvements of a process for producing a non-directional electrical steel sheet free from ridging, which comprises making a molten steel into slabs by continuous casting, hot rolling the slab, cold rolling the hot rolled product into a final thickness by a single step, and subjecting the cold rolled product to decarburization annealing, said molten steel consisting essentially of not more than 0.02% C, 1.5 to 4.0% Si, not more than 1.0% Al, with the balance being Fe and unavoidable impurities, said hot rolling being done at a temperature in a range of from 900° to 1100° C. before a finishing rolling of the hot rolling, said improvements comprising stirring electromagnetically unsolidified molten steel in a zone where the molten steel is at a temperature not higher than the liquidus line and remains in thickness not less than 50% to whole cast thickness, so as to allow not less than 50% of the slab central zone corresponding to a central zone of the hot rolled product which does not recrystallize during the hot rolling to transit into an equi-axed structure.

6 Claims, 6 Drawing Figures

( x10 )

Elongated Grains

Upper Surface of Hot Rolled Steel Strip (x2 )

Lower Surface of Hot Rolled Steel Strip

Slab Upper Surface

Central Portion of Slab Thickness

Slab Lower Surface ( $x\frac{1}{3}$ )

PROCESS FOR PRODUCING NON-DIRECTIONAL ELECTRICAL STEEL SHEETS FREE FROM RIDGING

BACKGROUND OF THE INVENTION

Field of the Invention

The present invention relates to a process for producing non-directional electrical steel sheets free from ridging, more particularly a method of continuous casting steel slabs suitable for producing non-directional electrical steel sheets free from ridging in which the molten steel is stirred by an electromagnetic force during the casting operation so as to improve the solidification structure at a specific zone of the slab central portion.

In recent years, the development of production techniques of non-directional electrical steel sheets has been very remarkable, and high-quality electrical steel sheets can now be produced thanks to improved methods for adjustment of the molten steel composition, progress in ingot-making techniques and improved production techniques for electrical steel sheets.

However, although the introduction of new and improved techniques as above possesses the advantage that high-quality electrical steel sheets can be obtained, it also has brought in new defects. Thus, in the production of non-directional electrical steel sheets, when molten steel having adjusted composition is cast into slabs by continuous casting and such continuous casting slabs are given various workings, vertical stripes continue in the rolling direction, or so-called "ridging" appears on the steel sheets. The vertical stripes, or "ridging" deteriorate the surface appearance and commercial value of the sheets, and it is unavoidable that the space factors, etc. are lowered when such defective sheets are formed into layer-built iron cores, etc.

As for the causes for the ridging, various hypotheses have been advocated in connection with stainless steel sheets, but there has been established no definite theory, and this is true also in case of electrical steel sheets.

Various studies and experiments have been conducted by the present inventors for the purpose of clarifying the causes of the ridging, and it has been found that large elongated grains which are formed during the hot rolling and cannot be recrystallized thereafter cause the ridging and that the formation of these large elongated grains depends on the cast structure.

Descriptions will be made by referring to the attached drawings.

BRIEF DESCRIPTION OF THE DRAWINGS

FIG. 1(*b*) is a microphotograph showing a part of the macro-structure in FIG. 1(*a*) in expansion.

Figure 1B:
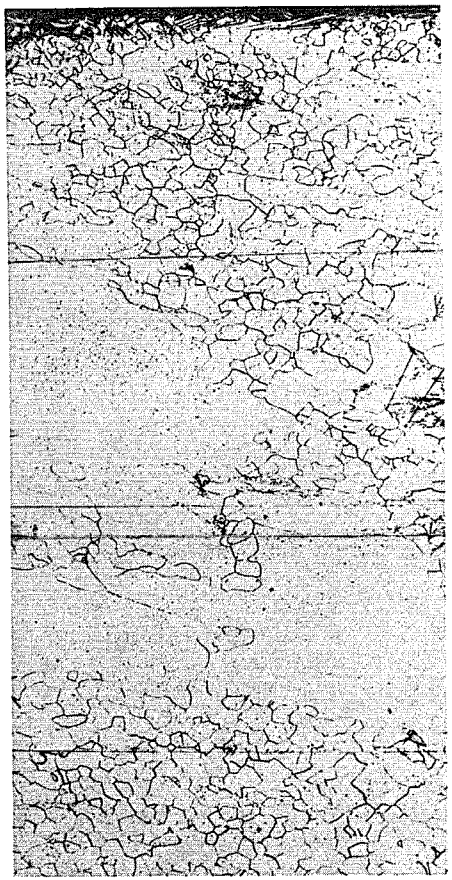
FIG. 1(*a*) is a photograph showing the macrostructure of the cross section perpendicular to the rolling direction of the hot rolled steel strip taken at an intermediate stage of the hot rolling.
Figure 1A:
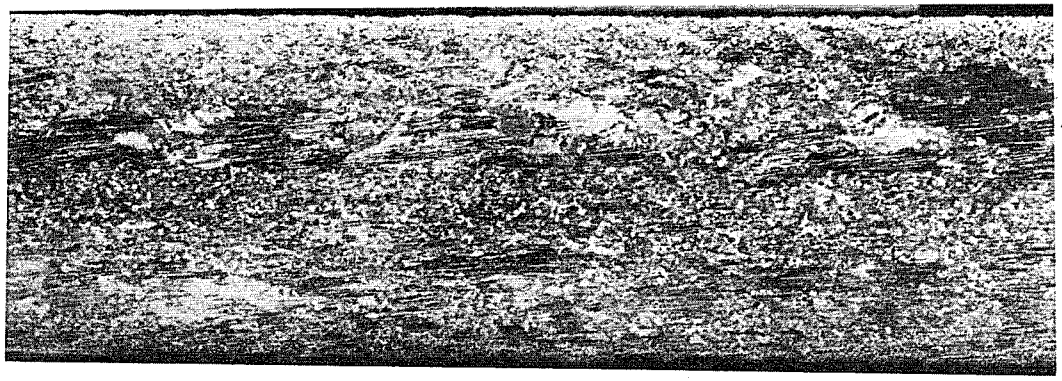

Thus, among hot rolled steel sheet samples of about 30 mm in thickness taken in the intermediate stage of the hot rolling, those samples containing a large amount of the giant grains elongated in the rolling direction as shown in FIG. 1, which cannot be recrystallized (hereinafter called simply "elongated grains"), suffer from the ridging without exception when subsequently cold rolled and annealed. Therefore, it is possible to prevent the ridging if the formation of the elongated grains can be prevented.

Further studies on the causes of the formation of the elongated grains have revealed that it has a close connection with the solidification structure of the continuously cast slab.

Figure 2:
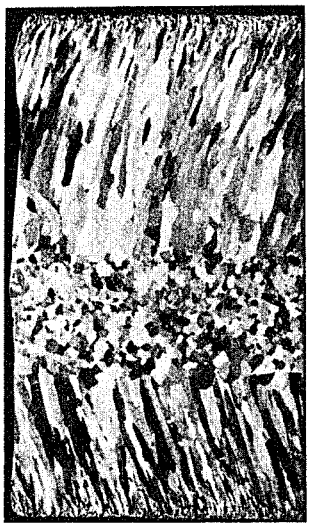
FIG. 2 is a photograph showing a macro-structure of the cross section parallel to the casting direction of the non-directional electrical steel slab cast by a continuous casting machine of the bow type.

The solidification structure of a cast slab continuously cast by a continuous casting machine of bow type contains fine chill grains in its surfacial portion, a columnar structure long extending in one direction adjacent to the fine chilled structure, and equi-axed grain zone somewhat below the central portion as shown in FIG. 2.

The equi-axed grain zone develops below the central portion, restricting the lower side of the columnar grain zone. This is the typical pattern of the solidification structure of a steel slab continuously cast by the bow type machine.

Figure 3:
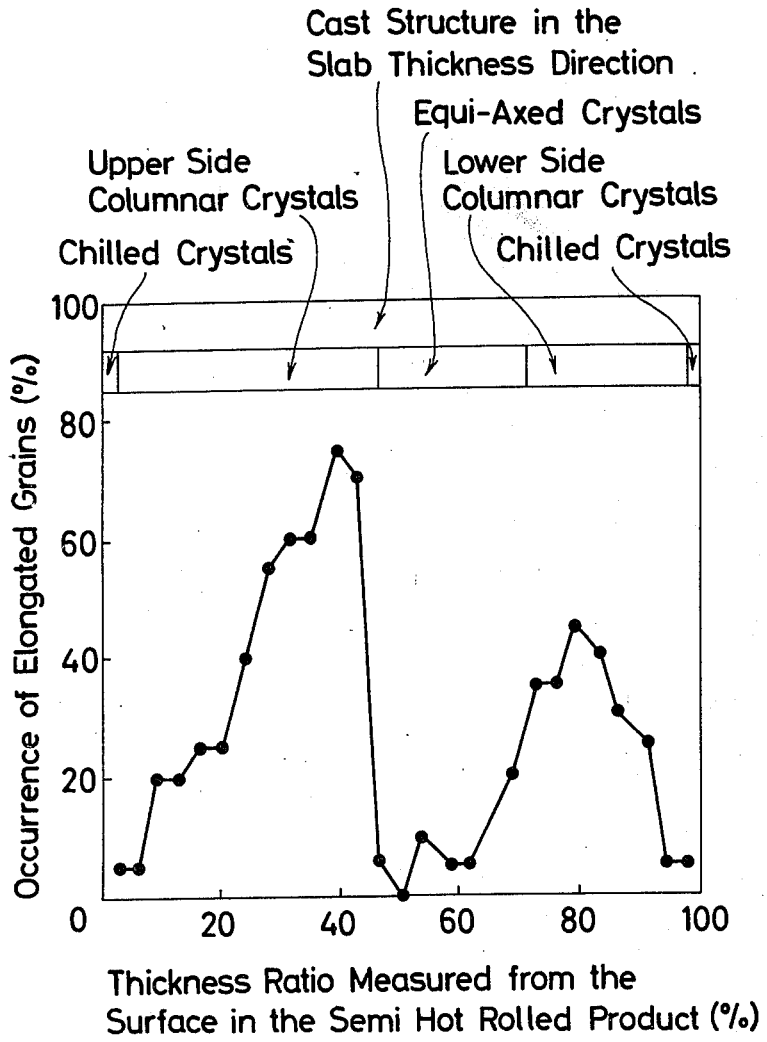
FIG. 3 is a graph showing schematically the correspondence between the cast structure of the slab and the occurrence frequency of the elongated grains in the thickness direction in the hot rolled steel strip (called semi-hot rolled product) taken in the intermediate stage of the hot rolling.

When the occurrence frequency of the elongated grains observable in the hot rolled steel sheet taken in the intermediate stage of the hot rolling at various positions in the thickness direction is plotted, this distribution is as shown in FIG. 3 and this distribution has a close relation with the solidification structure of the steel slab shown in the drawing.

Thus, in the lower portion below the center of the thickness of the hot rolled steel sheet, corresponding to the equi-axed grain zone of the cast slab, the occurrence frequency of the elongated grains decreases sharply, but on the other hand, in the portion corresponding to the columnar grain zone, the occurrence frequency of the elongated grains increases from the surface to the inside of the hot rolled steel sheet. The reasons for the decreasing the occurrence of the elongated grains in the surfacial portion are that the surfacial portion is at a lower temperature than the central portion, thus accumulating a larger amount of the strain energy caused by the hot rolling, and the temperature is higher than the recrystallization temperature, so that the structure becomes a fine recrystallized structure. Also the accumulation of strain energy depends also on the grain size, and the amount of accumulated strain energy increases as the grain size becomes smaller. In other words, the recrystallization takes place more easily.

Therefore, the cause for the increasing occurrence frequency of the elongated grains toward the inside of the steel sheet can be attributed to the fact that the accumulation of strain energy decreases due to the following two factors:

(1) the high temperature which permits relief of the strain (2) the large grain size which results in less grain bounderies accumulating the strain.

The reason why the occurrence of the elongated grains is suspended in the equi-axed grain zone is that the amount of the accumulated strain energy increases due to the fire grain size in the zone.

The occurrence frequency of the elongated grains shown in FIG. 3 is based on the results which have been obtained by taking samples of 2.0 cm in width from 20 spots at equal interval in the width direction of the hot rolled steel sheet, equally dividing each sample into 30 parts in the thickness direction and observing the presence of the elongated grains at various positions of the steel sheet. Therefore, in the surfacial portion where the occurrence frequency is low and in the portions corresponding to the equi-axed crystal zone of the steel slab, the size of the individual elongated grains is smaller than that in the portions where the occurrence frequency is high.

On the basis of the results obtained by extensive and wide investigations as above on the hot rolled steel sheets and numerous ridging estimations on the products obtained from the steel sheets, the present invention has discovered that a non-directional electrical steel sheet free from ridging can be obtained when the maximum occurrence frequency of the elongated grains is maintained at 30% or less.

Therefore, according to this discovery, it is necessary to achieve less occurrence frequency of the elongated grains all across the whole thickness of the hot rolled steel sheet.

SUMMARY OF THE INVENTION

The process for producing a non-directional electrical steel sheet free from ridging according to the present invention comprises continuous casting a molten steel containing not more than 0.02% C., 1.5 to 4.0% Si, not more than 1.0% Al (including 0%) with the balance being unavoidable impurities into a slab, hot rolling the slab, cold rolling the hot rolled sheet into a final thickness by a single step, and subjecting the cold rolled strip to carburizing annealing, characterized in that the unsolidified molten steel at a temperature not higher than the liquidus line is stirred by an electromagnetic force during the continuous casting of the slab so as to allow not less than 50% in thickness of the central portion of the slab corresponding to the non-recrystallizable central zone of the hot rolled steel sheet or strip which depends on the hot rolling condition to transit into an equi-axed structure.

The minimum ratio in thickness of equi-axed crystal zone in the slab required for the above purpose is determined by the ratio in thickness of the recrystallized structure zone near the surface of the hot rolled steel sheet or strip to the whole thickness of the sheet or strip, which ratio depends on the hot rolling conditions, such as the hot rolling temperature, the rolling reduction and the rolling speed, and when the hot rolling is done at a low temperature with a high degree of reduction, so as to increase the thickness ratio of the recrystallized structure zone, it is possible to lower the required thickness ratio of equi-axed crystal zone in the slab.

Thus, it has been revealed by the present inventors that the temperature (expressed in the temperature before the finishing rolling) and the reduction amount of the final pass in the rough rolling during the hot rolling have the greatest influence on the thickness ratio of the recrystallized structure zone adjacent to the surface, and when the above fact is used as a guidance for the hot rolling, and the hot rolling is done, for example, with a final rough rolling pass temperature (temperature before the finishing rolling) at 980° C. and a reduction amount of 20 mm (28%), the thickness ratio of the recrystallized structure zone adjacent to the surface is about 15% on one side and the required minimum thickness ratio of equi-axed crystal zone in the slab by means of the electromagnetic stirring and mixing is about 70%.

Figure 4:
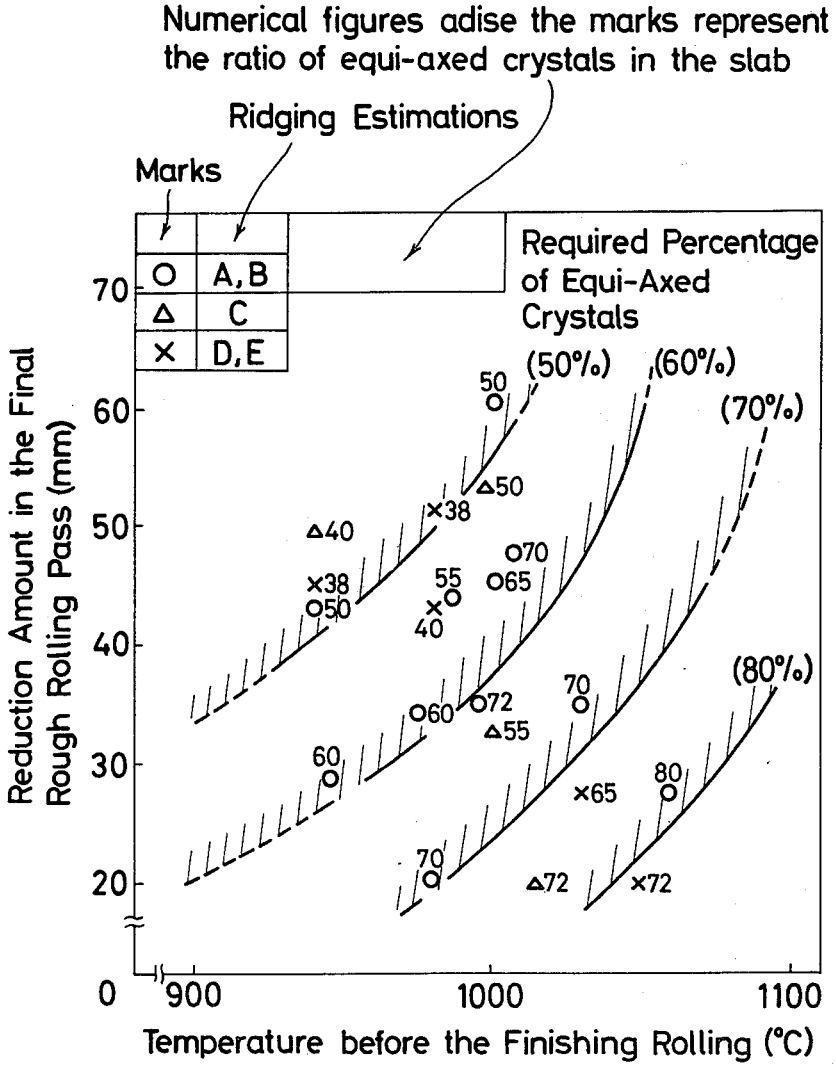
FIG. 4 shows the correspondence of the final rough rolling temperature and reduction in strip thickness of the slab having various ratios of the equi-axed crystals to the ridging marks in the final products after the final annealing.

In FIG. 4, the vertical axis represents the reduction amount by the final pass of the rough rolling in the hot rolling step, and the horizontal axis represents the temperature of the slab prior to the finishing rolling in the hot rolling step, and the estimation of ridging is identical to that mentioned in the subsequent examples, the numerical references appearing near the marks o,Δ, and x represent the percentage of the equi-axed crystal. Thus, FIG. 4 indicates the effects of the reduction amount of the final pass of the rough rolling and the slab temperature prior to the finishing rolling on the degree of ridging in the resultant final product produced from slabs having various percentages of equi-axed crystals.

Thus, the hot rolling conditions for obtaining the ridging estimation of o (A or B) for the various percentages of equi-axed crystals falls within the zones on or above the curves. In other words, if the hot rolling condition is determined, the required percentage of the equi-axed crystals can be determined from FIG. 4.

Meanwhile, when the hot rolling is done, for example, with a final rough rolling pass temperature (temperature before the finishing rolling) at 940° C. and a reduction amount of 43 mm (61%), the thickness ratio of the recrystallized structure zone on one side is about 25% and the required minimum thickness ratio equi-axed crystal zone in the slab by means of the electromagnetic stirring and mixing is about 50%.

Thus, it is understood that the required minimum thickness ratio of equi-axed zone in the slab can be lowered when the hot rolling is done at a lower temperature and with a higher reduction rate.

However, in a commercial production, it is difficult to select optionally the above hot rolling conditions. For example, the hot rolled steel strip coil obtained by the hot rolling deteriorates remarkably in its form when the temperature of the final rough rolling pass is too low, say lower than about 900° C. Therefore, extensive studies and experiments have been made on the required minimum thickness ratio of equi-axed crystal zone in the continuously cast slabs in connection with the temperature of the final rough rolling pass, particularly at about 900° C. or higher, and it has been found that when the reduction in strip thickness of the final rough rolling pass is within the normal range of from 20 to 60 mm, at least 50%, more preferably 60% in thickness of the equi-axed crystal zone to the whole thickness of the slab is required.

Regarding the upper limit of the temperature of the final rough rolling pass, the fact that a higher temperature is desirable means a higher heating temperature of the slab, but too high a temperature causes adverse effects on the magnetic properties of electrical steel sheets and promotes the grain growth in the slab at the heating stage, and is not desirable for the prevention of the ridging problem.

For the above reasons, it is desirable to set the upper limit of about 1100° C. for the temperature of the final rough rolling pass.

Hereinbelow, descriptions will be made on the conditions of the electromagnetic stirring or mixing of the molten steel during the continuous casting required for obtaining 50% or more thickness ratio of the equiaxed crystal zone.

The above required thickness ratio of the equiaxed crystal zone cannot be obtained when only the zone in which the unsolidified molten steel less than 50% in thickness to the whole cast thickness is electromagnetically stirred or mixed. Also it has been revealed that the columnar to equi-axed transition does not take place under the condition alone that the zone in which the molten steel is at or higher the liquidus line temperature, as explained hereinafter.

Therefore, in order to effect the columnar to equi-axed transition in the central portion covering 50% or more of the slab thickness, the electromagnetic stirring or mixing is given to a part or whole of the unsolidified molten steel in the zone where the molten steel is still present 50% or more in thickness to the whole cast thickness and at or lower the liquidus line temperature.

In the present invention, the electromagnetic stirring or mixing is specified for preventing the occurrence of the elongated grains for the following reasons.

From the aspect of the process, the methods for preventing the occurrence of the elongated grains can be classified into two groups:

(1) hot rolling at a low temperature, (2) increase of the thickness ratio of the equiaxed crystal zone in the slab.

However, in the preventive method (1), as described hereinbefore, when the desired result is to be obtained fully only by this method, the form of the resultant hot steel coil deteriorates, and thus this method is not desirable for commercial production. Then the method (2) alone or in combination of the method (1) is recommended. The method (2) may involve steps;

(2)-a. low-temperature casting, (2)-b. addition of inoculant to the molten steel, and (2)-c. electromagnetic stirring or mixing the molten steel.

The method involving the step of (2)-a has difficulty in controlling the temperature of the molten steel, thus disadvantageous in the operation, and cannot achieve satisfactory float-up separation of the non-metallic inclusions due to the low temperature of the molten steel, resulting in deterioration of the magnetic properties.

The method involving the step of (2)-b has defects such as formation of non-metallic inclusions, and a third phase which causes deterioration of the magnetic properties, because an appropriate method for adding inoculant has not been found. Therefore the method has considerable limitations in the commercial production.

Further in the method involving the step of (2)-a or (2)-b, the columnar to equi-axed transition in the central portion in the slab thickness required for prevention of the ridging is not always obtained, and the resultant equi-axed zone is not constant, and the thickness ratio of the equi-axed crystal zone in the casting direction is not stabilized.

Meanwhile, in the method involving the step of (2)-c, namely the electromagnetic stirring or mixing step, it is not necessary to change the molten steel composition, and to maintain the molten steel at low temperatures as in the low-temperature casting method. The resultant equi-axed zone is positioned constantly in the central portion in the slab thickness direction and it is easy to control the thickness ratio of the equi-axed zone. Thus, this method is most favourable for preventing the ridging in a non-directional electrical steel sheet.

For the reasons set forth above, the present invention is limited to the electromagnetic stirring or mixing.

The predominant factors in the casting operation which determine the thickness ratio of the equiaxed crystal zone in the cast slab obtained by the electromagnetic stirring are the slab size, the casting speed, and the casting temperature.

As the electromagnetic stirring conditions, the position of an electromagnetic stirring device, the zone affected by the electromagnetic stirring, the stirring mode, etc. may be mentioned.

Various hypotheses have been proposed on the formation of the equi-axed crystals by the electromagnetic stirring or mixing, but yet no definite theory has been established. However the experiments conducted by the present inventors have revealed that the formation of equi-axed crystals is caused only when the electromagnetic stirring or mixing is given to the molten steel at a temperature not higher than the liquidus line. Thus so far as the temperature of the molten steel is above the liquidus line, no formation of equi-axed crystals is caused, however, the stirring force may be increased, and the columnar crystals which have developed following the chilled crystals continue to grow.

Therefore, by controlling the casting speed and temperature in correspondence to various conditions including the slab thickness, the position of the electromagnetic stirring, the zone affected by the stirring or mixing which depends on the electromagnetic induction force, and the stirring or mixing mode, it becomes possible to obtain a steel slab having the required thickness ratio of the equi-axed crystal zone.

More detailed description will be made on the various limitations specified in the present invention.

The steel composition for the non-direction electrical steel sheet used in the present invention may be any one so far as it is suitable for the production of a non-directional electrical steel sheet, and may comprise:

C: less than 0.02% (by weight unless defined otherwise)

Si: 1.5 to 4.0%

Al: 0 to 1.0%

Bal.: Fe and unavoidable impurities

Regarding the carbon content in the steel used in the present invention, a lower content is desirable for the improvement of magnetic properties as well as for the relief of loads in the subsequent decarburization treatment. Therefore, it is desirable to set the upper limit of the carbon content at 0.02%.

Si is an essential element for obtaining the required magnetic properties, and at least 1.5% or more must be contained for achieving a high-grade quality, while the upper limit of the silicon content should be set at 4.0% in view of the limits in the cold rolling operation.

Although Al is not an essential element in the steel composition used in the present invention, it may be added for the purpose of improving the magnetic properties and adjusting the grains, but more than 1.0% addition should be avoided. With Al contents more than 1.0%, various difficulties are caused such that the hot rolling is hindered and the decarburization treatment becomes difficult. In the present invention, Al is not always added, but may be omitted.

The steel composition as illustrated above is melted according to a conventional method, such as in a converter and an electric furnace, and continuously cast into steel slabs of appropriate sizes.

The required minimum thickness ratio of the equi-axed crystal zone in the slab is determined on the basis of the following considerations.

Now the slab thickness is represented by "D"(mm), the required thickness ratio of the equi-axed crystal zone by "a"(%), the distance of the position of the electromagnetic stirring device from the surface of the molten steel by "L"(m), the casting speed by "V"(m/min.), the shell thickness by "S"(mm), the zone affected by the electromagnetic stirring above the position of the electromagnetic stirring device by "Lo"(m).

Then the development of the columnar crystals in the slab is suspended by the electromagnetic stirring when the slab is cast in the length of "L-Lo" from the meniscus so that equi-axed crystals are formed, and the structure formed within the slab by the molten steel which solidifies after this stage will be composed of equi-axed crystals. Therefore, the thickness ratio "a"(%) of the equi-axed crystal zone in the resultant slab may be expressed by the formula:

$$a = \frac{D - 2S}{D} \times 100\% \quad (1)$$

As "S" represents the distance of the position, where the columnar structure transits into the equi-axed structure from the slab surface, it represents also the thickness of the shell which solidifies during the casting of the length of (L-Lo).

In general, the solidifying thickness is in proportion to the square root of the time "t" after the casting, and the proportion coefficient "K" is called "solidification coefficient". Thus, "S" in the formula (1) is $$S = K\sqrt{t} \quad (2)$$

As "t" represents the time required for the casting of the length (L-Lo), and "V" represents the casting speed, $$t = \frac{L - Lo}{V} \quad (3)$$

Thus, the formula (1) is expressed $$a = \frac{D - 2K\sqrt{\frac{L - Lo}{V}}}{D} \quad (4)$$

The electromagnetic stirring device used in the present invention comprises a linear motor which forms a strong moving magnetic field arranged on both sides of the slab so as to stir the unsolidified molten steel portion by the electromagnetic induction force. The induction force may be expressed by "h" in the formula of $U_{max} = \sqrt{2gh}$ for converting the potential energy "mgh" into the kinetic energy $\frac{1}{2}mu_{max}^2$ in which "m" represents the mass (gram), "g" represents the gravitational acceleration (cm/sec.$^2$), "h" represents the height (cm), and "$U_{Max}$" represents the maximum flowing speed at the position of electromagnetic stirring (cm/sec.).

Figure 5:
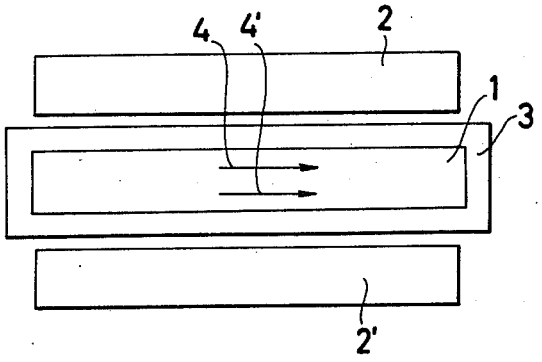
FIG. 5 shows schematically the electromagnetic stirring operation.

As for the stirring mode, various stirring patterns may be selected. For example, as schematically illustrated in FIG. 5, the molten steel is caused to flow in the direction of 4, 4' marked by the arrow through the remaining molten steel portion 1 by means of the linear motors 2, 2'. This case is called "normal-normal" flow, and when the molten steel is caused to flow in a contrary direction of the direction 4, 4', the flow is called "normal-reverse" flow. And the flow direction is not changed along the lapse of time, the flow is called "continuous" and when the flow direction is changed, the flow is called "alternate". Therefore, there are flow patterns such as "normal-normal continuous", "normal-normal alternate", "normal-reverse continuous" and "normal-reverse alternate".

The present invention will be more clearly understood from the following examples.

EXAMPLE

A steel composition as shown in Table 1 was prepared in a converter and cast under the conditions shown in Table 2, by a continuous casting machine, during which the unsolidified molten steel was stirred by the electromagnetic stirring to obtain a steel slab having an increased thickness ratio of the equi-axed crystal zone, and the slab thus obtained and the same steel slab but not subjected to the electromagnetic stirring were hot rolled into a hot coil, then annealed, acid pickled, and cold rolled.

The occurrence of the ridging in the products obtained from the slab subjected to the electromagnetic stirring and the slab not subjected to the same was observed, and the results are shown in Table 3 in comparison with the thickness ratio of the equi-axed crystal zone in the initial slabs, and the rolling conditions of the final rough rolling pass in the hot rolling.

As shown in Table 3, the thickness ratio of the equi-axed crystal zone in the slab subjected to the electromagnetic stirring is considerably increased as compared with that in the slab not subjected to the same, and it is clearly understood in comparison with the casting conditions in Table 2 that the thickness ratio of the equi-axed crystal zone in the slab subjected to the electromagnetic stirring is considerably affected by the super heat of the molten steel in the tundish, and as the super heat lowers, the ratio increases.

The occurrence of ridging varies in its degree depending not only on the thickness ratio of the equi-axed crystal zone in the slab, but also on the rolling conditions as understood from the comparison of the test pieces No. 1 and No. 4.

However, the results of the test pieces No. 1 and No. 5 show that under the same rolling conditions, the ridging mark varies depending on the thickness ratio of the equi-axed crystal zone, and the results of the test pieces No. 6 and No. 7 show that the ridging mark becomes inferior unless the required minimum thickness ratio of the equi-axed crystal zone is maintained even under more favourable conditions of low-temperature and high reduction rate.

TABLE 1

| Charge No. | Slab Composition (%) C | Si | Al |
|---|---|---|---|
| 1 | 0.005 | 2.75 | 0.274 |
| 2 | 0.011 | 2.84 | 0.386 |
| 3 | 0.010 | 2.20 | 0.318 |
| 4 | 0.006 | 2.80 | 0.380 |

TABLE 2

| Charge No. | Casting Condition: Superheat in Tundish (°C.) | Drawing Speed m/min. | Water Sprays l/Kg | Slab Thickness mm |
|---|---|---|---|---|
| 1 | 40–45 | 0.60 | 1.20 | 200 |
| 2 | 20–25 | 0.55 | " | 200 |
| 3 | 30–40 | 0.45–0.60 | " | 250 |
| 4 | 50–55 | 0.60 | " | 200 |

Remarks:
Bow type continuous casting machine (10.5 m radius).
Position of the electromagnetic stirring - 3.9 m below the meniscus
Current for the electromagnetic stirring coil - 1200A

TABLE 3

| Test No. | Classification | | Charge No. | Ratio of equi-axed crystal zone in slab (%) | Hot Rolling Conditions: Temp. before finishing rolling (°C.) | Reduction in last rough rolling pass (mm) | Product Quality: Watt loss $W_{10/50}$ | Ridging Estimates |
|---|---|---|---|---|---|---|---|---|
| 1 | Present | With | 1 | 55 | 980 | 43 | 1.18 | B |
| 2 | Invention | stirring | 2 | 72 | 995 | 35 | 1.15 | A |
| 3 | | | 3 | 65 | 1000 | 43 | 1.24 | A |
| 4 | Com- | | 1 | 55 | 1000 | 35 | 1.17 | C |
| 5 | parison | | 4 | 43 | 980 | 43 | 1.16 | C |
| 6 | Conven- | No | 2 | 38 | 940 | 45 | 1.13 | D |
| 7 | tional | stirring | 3 | 20 | 950 | 45 | 1.25 | E |

(Slab heating temperature: 1100°–1200° C.)

| Ridging Estimates | Ridging Rating (roughness) | |
|---|---|---|
| A | non | (<4.0 μ) |
| B | very slight | (4.0–5.5 μ) |
| C | slight | (5.6–7.0 μ) |
| D | moderate | (7.1–15.0 μ) |
| E | very severe | (>15 μ) |

What is claimed is:

1. In a process for producing a non-directional electrical steel sheet substantially free from ridging, which comprises forming a molten steel into slabs by continuous casting, hot rolling the slab, cold rolling the hot rolled product into a final thickness by a single step, and subjecting the cold rolled product to decarburization annealing, said molten steel consisting essentially of not more than 0.02% C., 1.5 to 4.0% Si, not more than 1.0% Al, with the balance being Fe and unavoidable impurities, the improvement which comprises electromagnetically stirring the unsolidified steel during the continuous casting in a zone where the molten steel is at a temperature which is not higher than the liquidus temperature so as to cause at least 50% of the central zone of the slab to transit into an equi-axed structure, and rough rolling the steel slab at a temperature range of 900° to 1100° C. with a reduction rate so as to obtain not more than 50% of a recrystallized structure.

2. A process according to claim 1 in which rough rolling of the slab is conducted at a reduction of 43 mm and at a temperature of 980° C. and wherein the percentage of the equi-axed crystal zone in the slab is 55%.

3. A process according to claim 1 in which rough rolling of the slab is conducted at a reduction of 35 mm and at a temperature of 995° C. and wherein the percentage of the equi-axed crystal zone in the slab is 72%.

4. A process according to claim 1 in which rough rolling of the slab is conducted at a reduction of 43 mm and at a temperature of 1000° C. and wherein the percentage of the equi-axed crystal zone in the slab is 65%.

5. A process according to claims 2 and 3 in which the slab thickness is 200 mm after casting.

6. A process according to claim 4 in which the slab thickness after casting is 250 mm.

* * * * *